US012760539B2

(12) United States Patent
Hassan et al.

(10) Patent No.: US 12,760,539 B2
(45) Date of Patent: Oct. 13, 2026

(54) CONCRETE FUNNEL

(71) Applicants: Mohamed A. Hassan, Stephens City, VA (US); Ahmed M. Hassan, Minneapolis, MN (US)

(72) Inventors: Mohamed A. Hassan, Stephens City, VA (US); Ahmed M. Hassan, Minneapolis, MN (US)

( * ) Notice: Subject to any disclaimer, the term of this patent is extended or adjusted under 35 U.S.C. 154(b) by 213 days.

(21) Appl. No.: 18/642,432

(22) Filed: Apr. 22, 2024

(65) Prior Publication Data

US 2024/0344345 A1 Oct. 17, 2024

Related U.S. Application Data

(63) Continuation-in-part of application No. 29/845,174, filed on Jul. 5, 2022, now Pat. No. Des. 1,024,140.

(51) Int. Cl.
*E04G 21/04* (2006.01)

(52) U.S. Cl.
CPC ..... *E04G 21/0481* (2013.01); *E04G 21/0472* (2013.01)

(58) Field of Classification Search
CPC ..... E04G 21/0481; E04G 21/0472
See application file for complete search history.

(56) References Cited

U.S. PATENT DOCUMENTS

| | | | | |
|---|---|---|---|---|
| 1,718,460 | A | 6/1929 | Hansen et al. | |
| 3,746,140 | A | 7/1973 | Schiffelbein | |
| 4,007,821 | A * | 2/1977 | Schiffelbein | E04G 21/04 193/4 |
| 4,455,232 | A | 6/1984 | Reid | |
| D314,270 | S | 1/1991 | Bryant | |
| 5,531,518 | A | 7/1996 | Alves | |
| 5,732,753 | A | 3/1998 | Danzi et al. | |
| 5,868,180 | A | 2/1999 | Hendrickson | |
| 5,950,934 | A | 9/1999 | Podesta et al. | |
| 6,076,710 | A | 6/2000 | Yates et al. | |
| 6,106,141 | A | 8/2000 | Bruun | |
| 6,155,277 | A | 12/2000 | Barry | |
| D459,365 | S | 6/2002 | Myers et al. | |
| 6,460,581 | B1 | 10/2002 | Marshall et al. | |
| 7,178,657 | B1 * | 2/2007 | Hafen | B65G 11/206 193/4 |
| 7,506,672 | B2 | 3/2009 | Manno | |
| 8,336,585 | B2 | 12/2012 | Royce | |
| 8,522,948 | B1 | 9/2013 | Galvin, IV | |
| D709,922 | S | 7/2014 | Zulu, Sr. et al. | |
| D710,912 | S | 8/2014 | Wehmeier | |
| D742,428 | S | 11/2015 | Barry | |
| D760,807 | S | 7/2016 | Sutton | |
| 9,856,085 | B1 | 1/2018 | Workman | |
| 9,950,444 | B2 | 4/2018 | Mcfarlane | |
| 2009/0229707 | A1 | 9/2009 | Royce | |
| 2013/0265843 | A1 | 10/2013 | Mayte | |

* cited by examiner

*Primary Examiner* — Jennifer C Chiang
(74) *Attorney, Agent, or Firm* — R. John Bartz

(57) ABSTRACT

An attachment for the discharge end of the delivery chute of a concrete mixer vehicle has a U-shaped body for receiving concrete discharged from the delivery chute. A downwardly directed discharge tube is in communication with an opening in the bottom of the U-shaped body and an open ended rectangular footer for directing concrete towards a desired location in a controlled and precise manner.

18 Claims, 5 Drawing Sheets

CONCRETE FUNNEL

CROSS REFERENCE TO RELATED APPLICATION

This application is a continuation-in-part of U.S. application Ser. No. 29/845,174 filed Jul. 5, 2022.

FIELD OF INVENTION

The invention is in the art relating to attachments for chute delivery mechanisms adapted for funneling cement in a determined direction and location from the container body of a cement mixer vehicle used in the construction industry.

BACKGROUND OF THE INVENTION

Equipment for dispensing freshly mixed concrete discharged from a concrete mixer vehicle is common. Typically, concrete mixer trucks have downwardly inclined concrete delivery chutes having a lower discharge end. Concrete discharged from the delivery chute is often largely uncontrolled leading to spillage and waste. It is especially difficult to deposit concrete in narrow areas and into concrete forms having small dimensions and narrow or irregular shapes. Examples of attachments for concrete delivery chutes for handling and controlling concrete flow are identified in the following U.S. patents.

R. A. Schiffelbein in U.S. Pat. No. 3,746,140 discloses a concrete delivery chute attachment having a flexible dispensing tube whereby concrete can freely pass from the delivery chute into and gravitate through the tube to selected positions below the discharge end of the delivery chute. K. B. Alves in U.S. Pat. No. 5,531,518 discloses an attachment for a concrete dispensing chute having a deflecting skirt located adjacent the discharge terminus of the chute for deflecting concrete discharged thereagainst.

SUMMARY OF THE INVENTION

The concrete funnel of the invention has a U-shaped body having an open front end and a closed back end. A pair of hooks joined to the front end of the U-shaped body are adapted to releasably attach to the discharge end of a concrete deliver chute of a concrete mixer vehicle. The U-shaped body has a discharge opening located between the open front end and the closed back end of the U-shaped body. The back end of the U-shaped body is closed with an inwardly inclined end wall. The inwardly inclined end wall extends from the top of the U-shaped body to immediately adjacent the discharge opening in the bottom of the U-shaped body whereby concrete discharged from the concrete deliver chute into the U-shaped body is deflected into the discharge opening. A downwardly directed discharge tube extends from the bottom of the U-shaped body in alignment with the discharge opening. A open ended foot having a rectangular shaped base is secured to the discharge tube opposite from the U-shaped body whereby concrete is funneled from a concrete discharge chute into confined and narrow areas without spillage and waste.

DETAILED DESCRIPTION

In the following detailed descriptions of the concrete funnel, reference is made to the accompanying drawing that form a part hereof, and in which are shown, by way of illustration, specific embodiments in which the invention may be practiced. It is to be understood that other embodiments may be utilized and structure changes may be made or other method steps and sequence thereof may be used without departing from the scope of the present invention. The concrete funnel is herein described as used in cement construction environments. The concrete funnel can have uses in other environments when flowable material delivery is desired.

Figure 1:
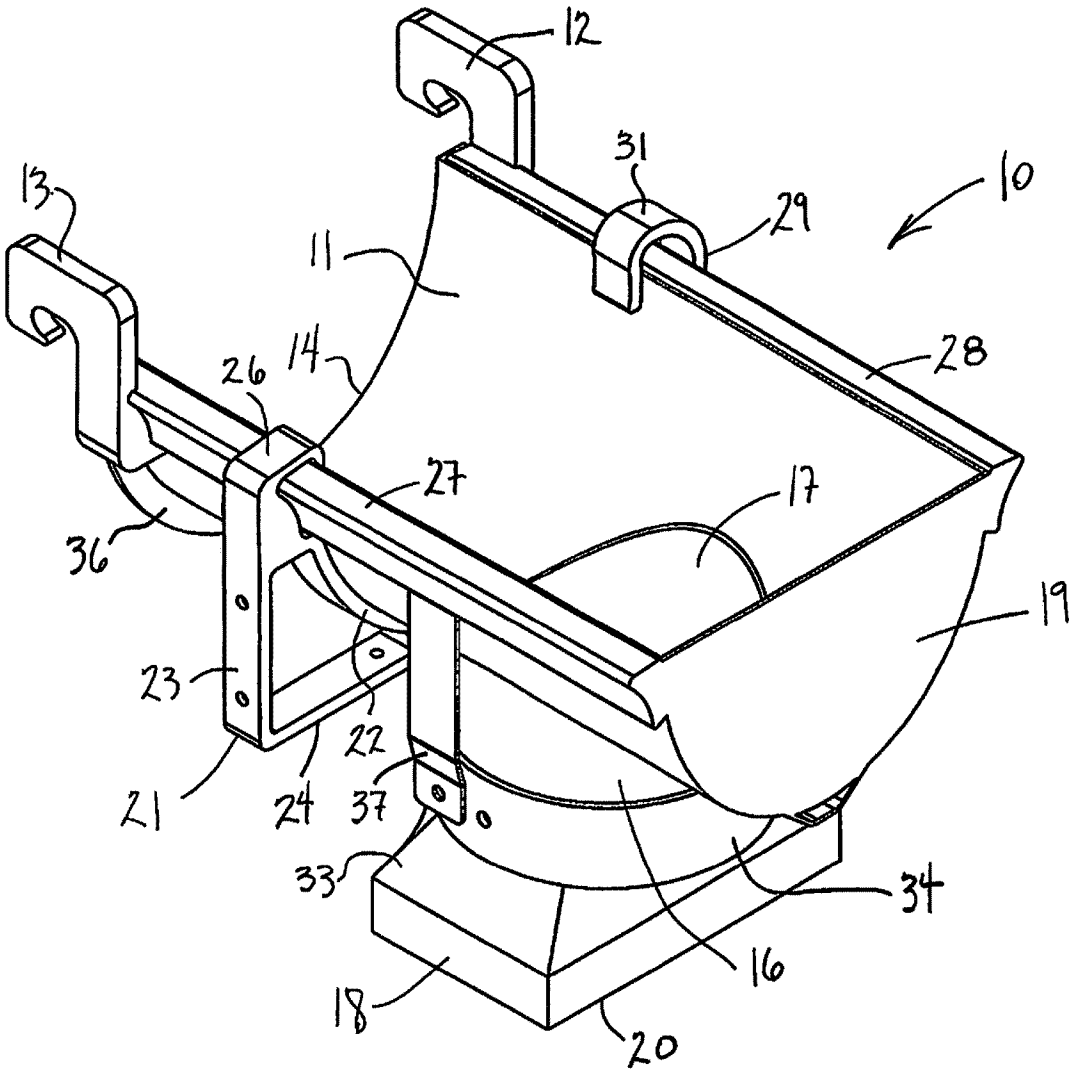
FIG. 1 is a perspective view of a concrete funnel adapted for attachment to the discharge end of the delivery chute of a concrete mixer vehicle.
Figure 2:
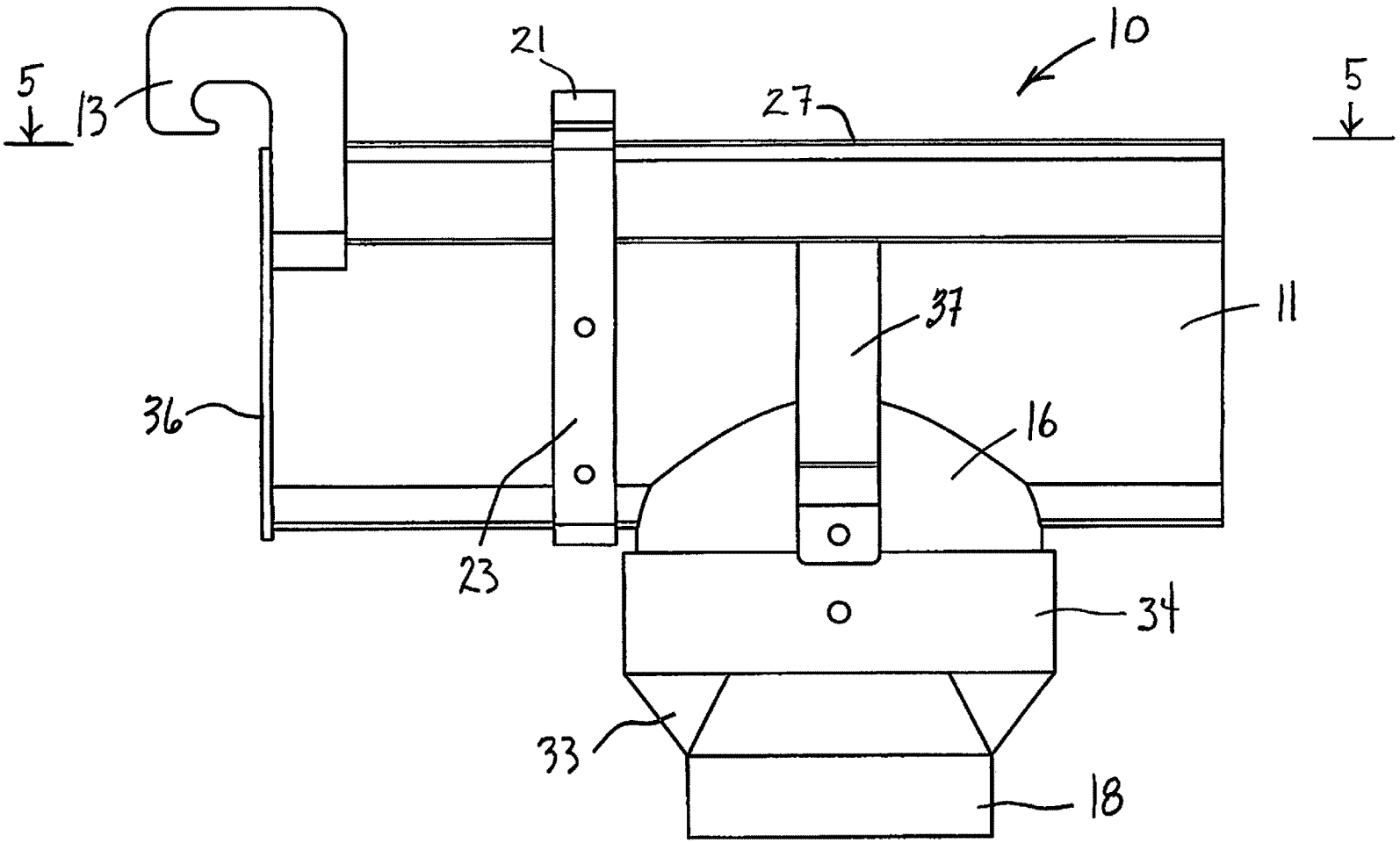
FIG. 2 is a left side elevational view of FIG. 1.
Figure 3:
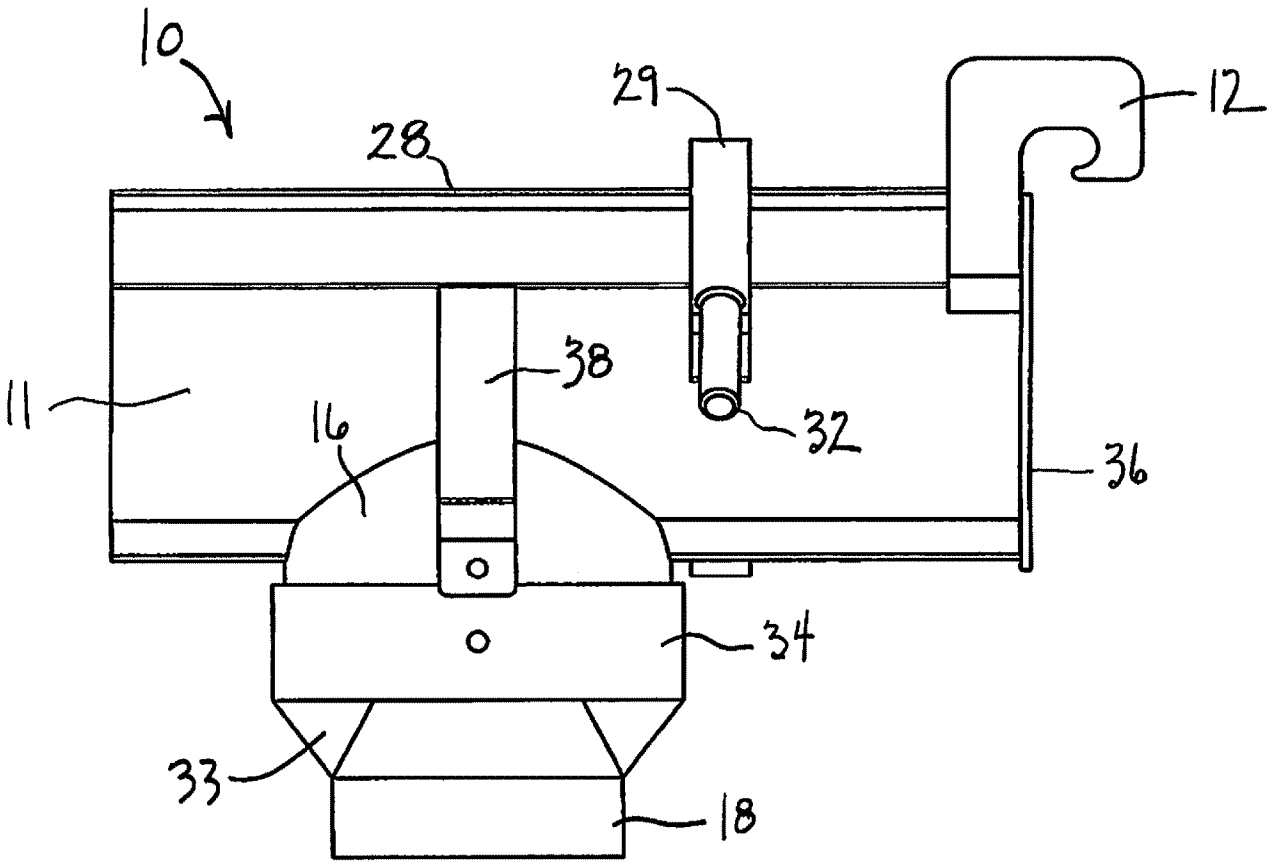
FIG. 3 is a right side elevational view of FIG. 1.
Figure 4:
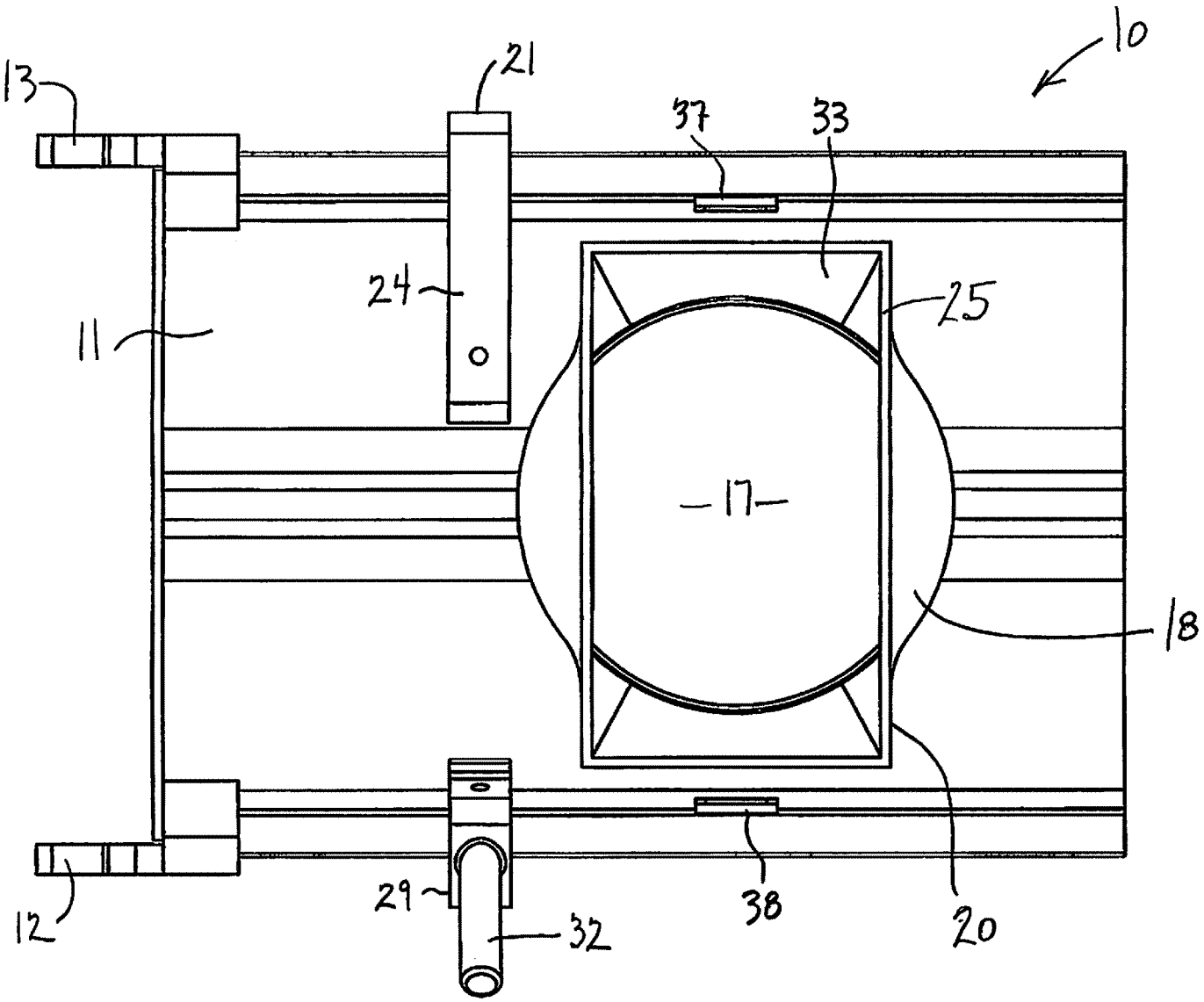
FIG. 4 is a bottom plan view of FIG. 1.
Figure 5:
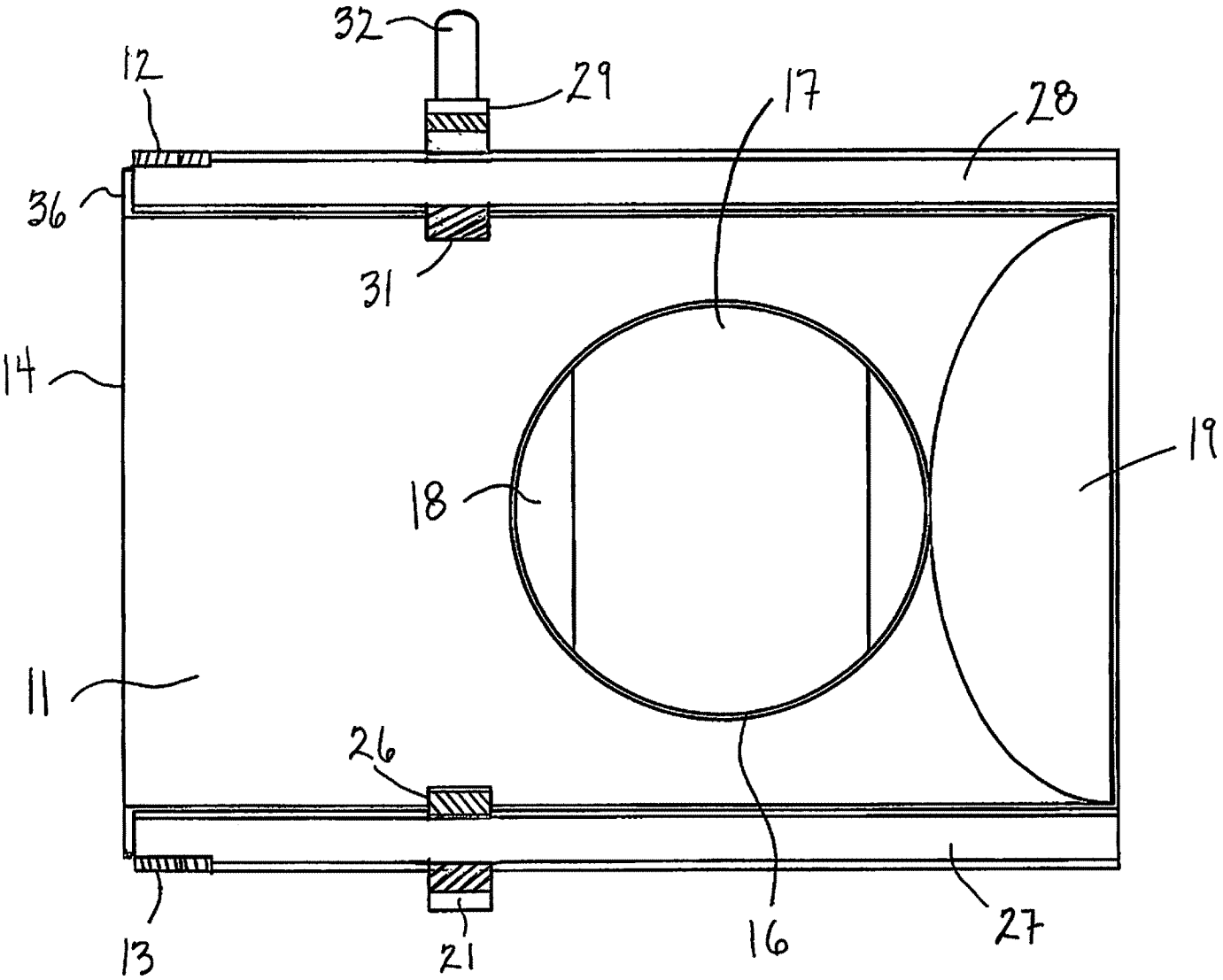
FIG. 5 is a sectional view taken along line 5-5 of FIG. 2.

Referring to FIGS. 1 to 5, there is shown a concrete funnel indicated generally at 10. Concrete funnel 10 is an attachment for a concrete delivery chute of a concrete mixer vehicle. Funnel 10, when attached to the discharge end of the delivery chute, receives and directs concrete flowing down the delivery chute to desired locations conveniently and accurately with minimal spillage and waste.

Funnel 10 has a hollow U-shaped body 11 having a pair of hooks 12 and 13 adjacent inlet end 14 of body 11. Hooks 12 and 13 are adapted to releasable attach to the discharge end of a concrete mixer vehicle delivery chute. A bearing plate 36 located on the inner end of body 11 facilitates attachment of funnel 10 and provides a greater bearing surface between funnel 10 and the discharge end of the concrete mixer vehicle delivery chute. Funnel 10 has a downwardly directed tube 16 extending from the bottom of body 11. Tube 16 is communication with and surrounds a concentric outlet opening 17 in the concave curved bottom wall of body 11. The bottom wall of U-shaped body 11 curves downwardly toward outlet opening 17 to prevent accumulation of concrete within body 11. An open-ended foot 18 is attached to the discharge end of tube 16. Foot 18 has an open ended rectangular shaped base 20 having a flat transverse lower surface 25 conducive for engaging and mating with concrete blocks and other concrete forms used in wall construction. The open end of base 20 has a transverse length that is greater than the diameter of opening 17 in body. Base 20 can have other sizes and shapes as desired. Foot 18 has an inwardly converging top end 33 extending to the bottom of tube 16. A collar 34 surrounds the bottom of tube 16 adjacent top end 33 of foot 18. Collar 34 is secured to tube 16 and foot 18 and holds foot 18 on tube 16. Collar 34 is removable to allow alternate feet to be utilized. An inwardly inclined end wall 19 extends from the top of body 11 to the bottom of body 11. The bottom of end wall 19 is located adjacent to and abuts the back of outlet opening 17. End wall 19 functions to deflect concrete into outlet opening 17. A bracket 21 having a concave curved bottom member 22 is attached to body 11. Bottom member 22 is located adjacent to the outer bottom surface of body 11. Bottom member 22 provides support for body 11. Bracket 21 is a triangular shaped member having a flat vertical side member 23 joined to a flat horizontal member 24. The top of bracket 21 has a hook 26 extending over top edge 27 of body 11. A handle 29 is mounted on top edge 28 of body opposite bracket 21. Handle 29 has a hook 31 extending over top edge 28 to hold handle 29 on body 11. Handle 29 has an outwardly and downwardly extending handgrip 32 useable to allow manual manipulation and movement of funnel 10 into selected positions as desired. A pair of downwardly extending support arms 37 and 38 is secured to opposite sides of body 11 rearwardly from bracket 21 and handle 29.

In use, when concrete is poured into concrete funnel 10 attached to the concrete delivery chute of a concrete mixer vehicle, the concrete moves through discharge opening 17 into discharge tube 16. The concave curved bottom wall of U-shaped body 11 cooperates with inwardly inclined end wall 19 to deflect concrete poured into body 11 through opening 17 and into discharge tube 16. The inwardly directed orientation of end wall 19 and the location of the bottom of wall 19 adjacent to opening 19 facilitate the deflection and movement of concrete toward and into opening 17. The concrete moves through tube 16 and is discharged out foot 18. The rectangular shaped base 20 of foot 18 conforms the concrete to a rectangular column flow to facilitate filling concrete forms used in wall construction and the like with minimal spillage and waste.

The foregoing drawing and description of the concrete funnel is one embodiment of the invention. Persons skilled in the art of attachments for concrete dispensing chutes can make changes and modifications of the structures and materials to the concrete funnel without departing from the concrete funnel defined in the claims.

The invention claimed is:

1. An attachment for a concrete delivery chute operable to receive and funnel concrete comprising:

a U-shaped body having an open front end, a back end and a discharge opening located between the open front end and the back end, an inwardly inclined end wall closing the back end of the U-shaped body, a pair of hooks joined to the U-shaped body adjacent the open front end, a bearing plate secured to the U-shaped body adjacent the open front end, the U-shaped body having a discharge opening located adjacent a bottom portion of the inwardly inclined end wall, a downwardly directed discharge tube extending from the U-shaped body, the downwardly directed discharge tube located in alignment with the discharge opening, a foot joined to the downwardly directed discharge tube opposite the U-shaped body, the foot having an inwardly converging top end joined to the downwardly directed discharge tube, a collar joined to the inwardly converging top end and the downwardly directed discharge tube securing the inwardly converging top end to the downwardly directed discharge tube, the foot having an open ended base extending downwardly from the inwardly converging top end opposite the downwardly directed discharge tube, a handle mounted on a first side of the U-shaped body rearwardly from the pair of hooks, a bracket secured to a second side of the U-shaped body opposite from the handle supporting the U-shaped body, and a pair of downwardly extending arms secured to the U-shaped body rearwardly from the handle and the bracket.

2. The attachment of claim 1 wherein:

the discharge opening has a rear portion abutting the bottom portion of the inwardly inclined end wall.

3. The attachment of claim 1 wherein:

the handle includes a handgrip.

4. The attachment of claim 1 wherein:

the collar is a removable collar releasably securing the inwardly converging top end to the downwardly directed discharge tube.

5. The attachment of claim 1 wherein:

the open ended base is a rectangular shaped open ended base.

6. An attachment for a concrete delivery chute operable to receive and funnel concrete discharged from the concrete delivery chute comprising:

a body having an open front end and a back end opposite from the open front end, an opening located between the open front end and the back end, an end wall closing the back end of the body, a tube secured to the body in alignment with the opening, a pair of hooks secured to the body adapted to attach the body to the concrete delivery chute, and a foot secured to the tube opposite from the body, the foot including an open ended base, the open ended base having a flat lower surface whereby concrete discharged into the body is directed through the tube and the foot and discharged from the open ended base.

7. The attachment of claim 6 including:

a handle mounted on the body.

8. The attachment of claim 6 including:

a collar surrounding the foot and the tube securing the foot to the tube.

9. The attachment of claim 8 wherein:

the collar is a removable collar releasably securing the foot to the tube.

10. The attachment of claim 6 including;

a bracket secured to the body opposite from the handle supporting the body.

11. The attachment of claim 6 wherein:

the body is a U-shaped body, the end wall being an inwardly inclined end wall, the inwardly inclined end wall having a bottom portion abutting a rear portion of the opening.

12. The attachment of claim 6 wherein:

the open ended base is a rectangular shaped open ended base.

13. The attachment of claim 6 wherein:

the foot includes an inwardly converging top end, a collar surrounding the inwardly converging top end and the tube to secure the inwardly converging top end to the tube.

14. A method of directing pourable concrete into a concrete form comprising:

providing a U-shaped body having an open front end and a back end opposite from the open front end, closing the back end of the U-shaped body with an end wall, providing the U-shaped body with a discharge opening between the open front end and the end wall, inclining the end wall downwardly toward the discharge opening, abutting a bottom portion of the end wall to a rear portion of the discharge opening, discharging pourable concrete into the U-shaped body, deflecting the pourable concrete off the end wall through the discharge opening, securing a downwardly directed discharge tube to the U-shaped body, aligning the downwardly directed discharge tube with the discharge opening, securing a foot to the downwardly directed discharge tube opposite from the U-shaped body, providing the foot with an open ended base, discharging pourable concrete into the U-shaped body, deflecting the pourable concrete off the U-shaped body and the end wall through the discharge opening into the downwardly directed discharge tube, funneling the pourable concrete through the foot and the open ended base whereby pourable concrete is discharged into the concrete form.

15. The method of claim 12 including:

releasably securing the foot to the downwardly directed discharge tube.

16. The method of claim 12 wherein:

the open ended base is a rectangular shaped open ended base.

17. The method of claim 14 including:

discharging the pourable concrete from the open ended base in a rectangular column flow.

18. The method of claim 14 including:

engaging the open ended base of the footer to the concrete form.

* * * * *